US005248060A

United States Patent [19]

Friedman et al.

[11] Patent Number: 5,248,060

[45] Date of Patent: Sep. 28, 1993

[54] THEFT DETERRENT DEVICE FOR NEWSPAPER DISPENSING MACHINES

[75] Inventors: Evelyn Friedman; William Carswell; Howard Shames; Martin Borho, all of Whitehall, N.Y.

[73] Assignee: EB Metal Industries, Inc., Whitehall, N.Y.

[21] Appl. No.: 838,142

[22] Filed: Feb. 18, 1992

[51] Int. Cl.[5] ..... G07F 11/04

[52] U.S. Cl. ..... 221/28; 221/154; 221/155; 221/241; 221/304; 194/350; 49/142

[58] Field of Search ..... 221/28, 151, 152, 154, 221/155, 241, 242, 304; 194/350, 227; 49/142

[56] References Cited

U.S. PATENT DOCUMENTS

| | | | |
|---|---|---|---|
| 3,536,231 | 10/1970 | Knickerbocker . | |
| 3,747,733 | 7/1973 | Knickerbocker . | |
| 3,831,809 | 8/1974 | Knickerbocker . | |
| 4,106,609 | 8/1978 | Kaspar . | |
| 4,410,104 | 10/1983 | Carswell et al. | 221/241 |
| 4,445,625 | 5/1984 | Friedman . | |
| 4,700,869 | 10/1987 | Bogner | 221/241 X |
| 4,981,236 | 1/1991 | Riedle . | |
| 5,018,940 | 5/1991 | Hognestad et al. | 221/241 X |

FOREIGN PATENT DOCUMENTS

| | | |
|---|---|---|
| 659146A | 12/1986 | Sweden . |
| 2124604A | 2/1984 | United Kingdom . |

OTHER PUBLICATIONS

Sho-Rack Coin Operated Newspaper Racks, "One-By-One", Kaspar Wire Works, Inc., Mar. 1991, p. 1.

*Primary Examiner*—Robert P. Olszewski
*Assistant Examiner*—Dean A. Reichard
*Attorney, Agent, or Firm*—Leo Zucker

[57] ABSTRACT

A theft deterrent device restricts the number of newspapers or other periodicals that can be retrieved from a newspaper vending machine at one time. The device includes a cover gate forming a generally T-shaped opening with a vertical passageway and a horizontal slot opening. The cover gate mounts over an access opening of the vending machine behind a hinged door that closes against the vending machine. The cover gate restricts the number of periodicals that can be withdrawn at one time from a storage cabinet portion of the machine after the hinged door is opened and lowered by a customer. The deterrent device is easily installed on existing newspaper vending machines by way of an engagement member that securely engages a fixed part of the vending machine in the region of the access opening. A lock mechanism on the cover gate serves to lock the cover gate to the dispensing machine and firmly hold the gate in place over the access opening.

24 Claims, 5 Drawing Sheets

THEFT DETERRENT DEVICE FOR NEWSPAPER DISPENSING MACHINES

BACKGROUND OF THE INVENTION

1. Field of the Invention

The present invention relates generally to theft deterrent or guard mechanisms for use in newspaper and periodical vending machines, and particularly to a newspaper theft deterrent assembly that can be easily fitted to existing coin-operated newspaper dispensing machines.

2. Description of the Known Art

Anti-theft or guard devices for use in newspaper dispensing machines are known generally.

U.S. Pat. Nos. 4,410,104 (Oct. 18, 1983) and 4,445,625 (May 1, 1984), both assigned to the assignee of the present invention, disclose vending machines having an access opening sized to permit withdrawal of a single newspaper or magazine, and a mechanism by which the access opening becomes closed by blocking members to prevent removal of additional articles after the topmost article is withdrawn through the opening.

An assembly known as the "One-By-One/Sho-Rack" made by Kaspar Wire Works, Inc. of Shiner, Tex., comprises a metal shield plate having a generally "T"-shaped cutout. The horizontal opening of the cutout has a solid flap behind it, and the entire plate assembly is installed at the front of the access opening of a newspaper vending machine. Once the vending machine door is unlocked, the customer reaches through the vertical part of the cutout and grasps only the topmost newspaper from a stack in the machine. The newspaper is guided out through the horizontal top opening with the flap moving an amount sufficient to allow only a single newspaper to be withdrawn. The device has a disadvantage, however, in that it must be installed in the existing machines by a mechanic with tools and hardware. Also, any malfunctions in the operation of the flap mechanism may interrupt the normal dispensing function of the machine and be difficult to repair on-site.

U.S. Pat. No. 4,981,236 (Jan. 1, 1991) discloses a newspaper anti-theft device having three separate components or sub-assemblies including a cover panel sub-assembly, a cover panel mounting bracket and a reset tab mounting bracket. A cover panel having a restrictive access opening is mounted behind the access door of a newspaper dispensing machine, and a restriction mechanism for restricting removal of newspapers through a T-shaped opening in the cover panel is provided. The restriction mechanism includes a gauge gate pivoted on the cover panel above the access opening, means for adjusting of the gauge gate for newspapers of varying thickness, and locking means associated with the gauge gate to prevent successive withdrawal of newspapers through the horizontal slot of the T-shaped access opening. As with the "One-By-One" anti-theft device mentioned above, installation of the device of the '236 patent requires special tools and hardware, ongoing operation of the dispensing machine may become impaired, in case of a malfunction and on-site repairs may be impossible to carry out.

Other various arrangements for dispensing only one newspaper at a time from a stack inside a dispensing machine are disclosed in U.S. Pat. Nos. 3,536,231 (Oct. 27, 1970); 3,747,733 (Jul. 24, 1973) and 3,831,809 (Aug. 27, 1974).

A removable front panel for a newspaper vending machine is disclosed in U.S. Pat. No. 4,106,609 (Aug. 15, 1978).

SUMMARY OF THE INVENTION

An object of the invention is to overcome the above and other disadvantages of the known newspaper theft deterrent devices.

Another object of the invention is to provide a newspaper theft deterrent device that can be installed easily on existing newspaper vending machines, without the need for special tools or hardware.

A further object of the invention is to provide a newspaper theft deterrent device having a slotted opening that can be adjusted to accommodate newspapers of various thicknesses, using an uncomplicated adjustment mechanism that can be easily operated and will not fail during use over time.

Another object of the invention is to provide a newspaper theft deterrent device that can be locked in place in an existing newspaper dispensing machine using a simple key lock mechanism and, when unlocked, can be positioned so as not to interfere with the bulk loading of newspapers into the machine.

Another object of the invention is to provide a newspaper theft deterrent device of substantially one piece construction and which can be directly hinged and locked to door frame openings of storage cabinets in existing newspaper machines.

According to the invention, a theft deterrent device restricts the number of newspapers, periodicals or other articles that can be retrieved from inside a newspaper vending or dispensing machine of the kind having a hinged door for covering an access opening of the machine and through which opening articles can be loaded into a storage portion of the machine. The device includes cover gate means forming a generally T-shaped opening with a vertical passageway and a horizontal slot opening, for mounting behind the hinged door in the region of the access opening and for restricting the number of articles that can be withdrawn at a time from the storage portion, engagement means on the cover gate means for securely engaging a fixed member that forms a part of the dispensing machine in the region of the access opening, and lock means on the cover gate means for locking the cover gate means to the dispensing machine over the access opening after the engagement means engages the fixed member.

The vertical passageway in the cover gate means is of a width just sufficient to allow a customer to pass his/her hand through the gate means to grasp a topmost article stacked in the storage portion after the machine door is opened by the customer, and the horizontal opening is of a width just sufficient to enable the customer to withdraw the topmost article in the storage portion through the slot opening and out of the dispensing machine before the door is released by the customer and closed against the machine.

For a better understanding of the present invention, together with other and further objects, reference is made to the following description taken in conjunction with the accompanying drawing, and the scope of the invention will be pointed out in the appended claims.

DETAILED DESCRIPTION OF THE INVENTION

Figure 1:
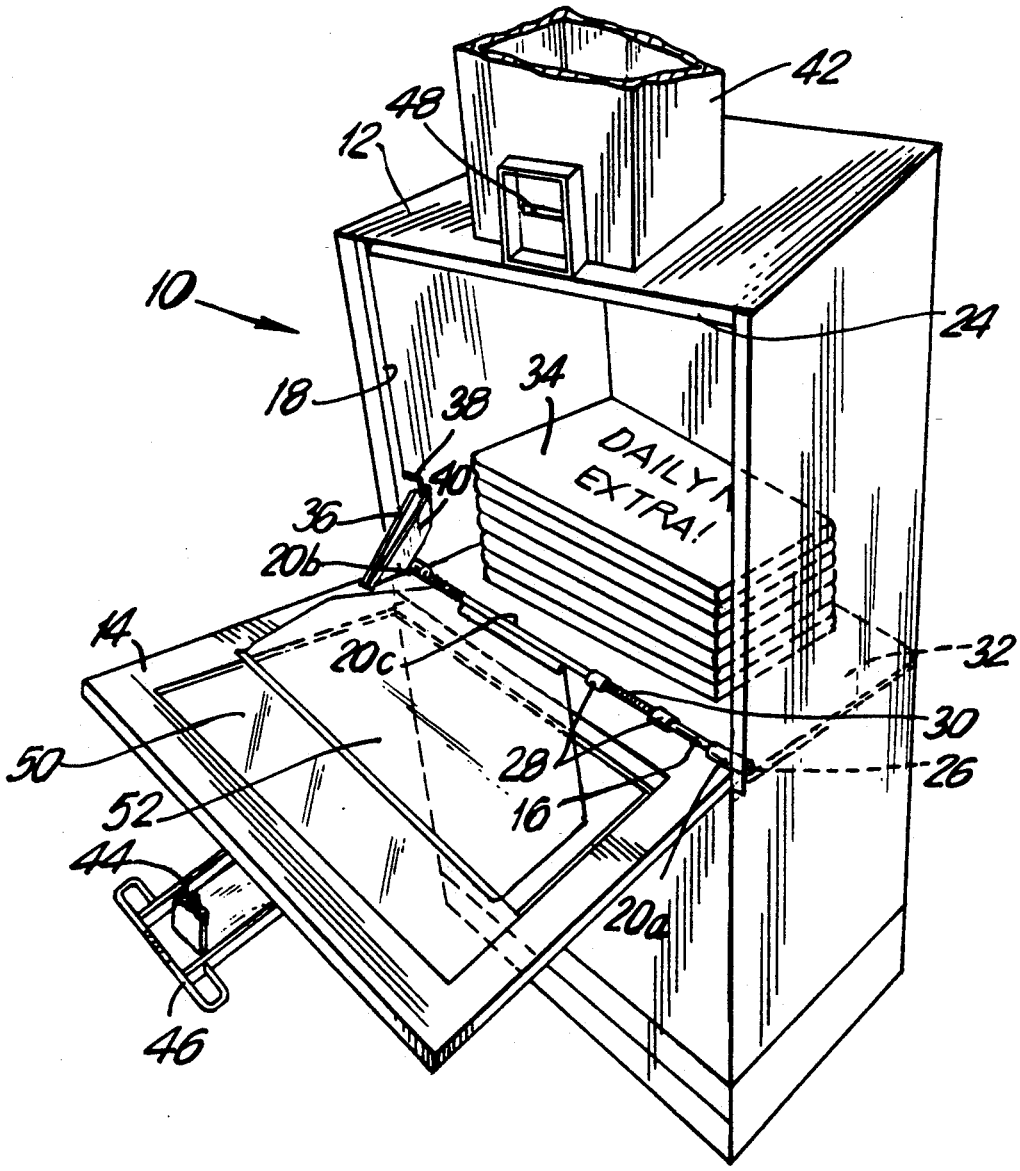
(PRIOR ART) FIG. 1
FIG. 1 is a perspective view of a conventional newspaper or periodical vending machine.

FIG. 1 is a perspective view of a conventional newspaper or periodical vending machine 10 with which the theft deterrent device of the present invention can be used effectively.

The dispensing or vending machine 10 may be of the kind known in the trade as a type "31" or a type "80" machine manufactured, for example, by EB Metal Industries, Inc. of Whitehall, N.Y. under the designations EB 31, EBT 31, EB 80 or EBT 80.

Basically, the machine 10 is in the form of a sheet metal cabinet 12 arranged to stand directly on the ground or a sidewalk as is the machine 10 depicted in FIG. 1, or the cabinet 12 may itself be mounted atop a post or fixed at one side to a pole supported firmly on the ground (not shown). In any event, the theft deterrent device hereafter disclosed and claimed may be applied to most all of the known newspaper/periodical vending machines as will be understood from the present disclosure.

The machine 10 in FIG. 1 has a hinged door 14 that pivots about a door hinge rod 16. The door hinge rod 16 is fixed in position along the bottom edge of a newspaper access opening 18 in cabinet 12, by sheet metal ferrules formed near the inside walls of the cabinet 12 at 20*a* and 20*b*, and centrally along the lower edge of the access opening 18, at 20*c*. Ferrules 20*a*–20*c* may be formed integrally with the sheet metal cabinet 12. The cabinet 12 has a frontal inside flange 24 that defines the top and the sides of the access opening 18. For added strength, the ferrules 20*a*, 20*b* may be welded at their outwardly facing ends to the flange 24 as shown, for example, at 26.

The hinged door 14 has two pair of hinge hook members along its lower inside edge for pivotally engaging the door hinge rod 16, one pair 28 of the hinge hook members being visible at the lower right edge of the door 14 in FIG. 1. Hinged door 14 is biased or urged toward a closed position by a pair of coil spring members fitted concentrically over the hinge rod 16. The spring members are located between each pair of hinge hook members, one coil spring member 30 being shown between the hook members 28 in FIG. 1. Each coil spring member is set with one end of its spring fixed to an inside shelf 32 of the cabinet 12, and the other end of the spring is fixed to the lower inside edge of the door 14. The spring members are pre-set to apply a certain amount of torsion to the door 14 to maintain the door firmly in a closed position. Door 14 is thus spring loaded when opened as in FIG. 1. When newspapers are loaded on the shelf 32 of the cabinet 12 by a newspaper delivery person, a pivoted stop bar 36 is arranged to be swung to a position at which it abuts a projecting portion 38 on the inside flange 24. The stop bar 36 is pivoted to an arm member 40 fixed at one end to the lower left rear edge of the door 14. The distal end of the arm member 40 bends behind the flange 24 and abuts the rear side of the flange when door 14 is lowered to a horizontal position, thus defining a fully opened position for the door.

A coin or currency receiving mechanism 42 is often mounted atop the newspaper vending machine 10. Further illustration of the mechanism 42 appears in FIG. 2. Mechanism 42 operates to lock onto a tongue member 44 that projects from a door handle 46 mounted centrally at the top of the door 14. Tongue member 44 enters into a slot opening 48 formed near the bottom of the mechanism 42 when the door 14 is closed. A locking device (not shown) inside the mechanism 42 prevents the tongue member 44 from being withdrawn if someone attempts to pull on the handle 46, unless a preset quantity of coins or a certain amount of currency is deposited into or registered by the mechanism 42.

It will be understood that once the prescribed amount of coins or currency is registered by the mechanism 42 and the tongue member 44 on the handle 46 is released, the door 14 can be opened by the paying customer and access may be had through the opening 18 not just to one but to the entire stack of newspapers 34 remaining in the cabinet 12. Access may also be had to a display copy of the current newspaper (not shown) which is held against a display window 50 mounted on the door 14 by a display paper holder 52 fixed at one end to the lower rear surface of the door 14.

There are occasions when certain periodicals are vended "free" and the machine 10 may lack any coin receiving mechanism for accepting customer payment. That is, door 14 is not locked to the machine 10 when closed. The present device may also be used advantageously in such free vending applications where it is still essential to assure that no more than one item is dispensed at one time to each customer.

Unfortunately, some persons are not honest enough to take just one item from the top of the stack of newspapers 34 or other periodicals after opening the door 14, whether or not a prior payment was required. Persons may take extra copies for family and friends, or sell them to passersby. Newspaper and magazine publishing companies have suffered significant losses because of such pilferage, and anti-theft restriction devices have been developed with the aim of permitting only one of a stack of newspapers or other periodicals stored in the cabinet 12 to be withdrawn upon opening the machine door. Such devices are discussed above in the background portion of the present specification.

The theft deterrent device of the present invention was developed to provide a cost effective means of thwarting attempts by some dishonest persons to steal a large quantity of newspapers from vending machines such as the machine 10 in FIG. 1. The present device does not require the newspaper publisher or distributor, who may own or operate the machine 10, to expend large sums of money for a complex theft deterrent mechanism as well as for its installation, servicing and repair in the field. Moreover, a theft deterrent device that can be quickly and easily installed without tools and additional hardware will ensure cost effectiveness.

Figure 2:
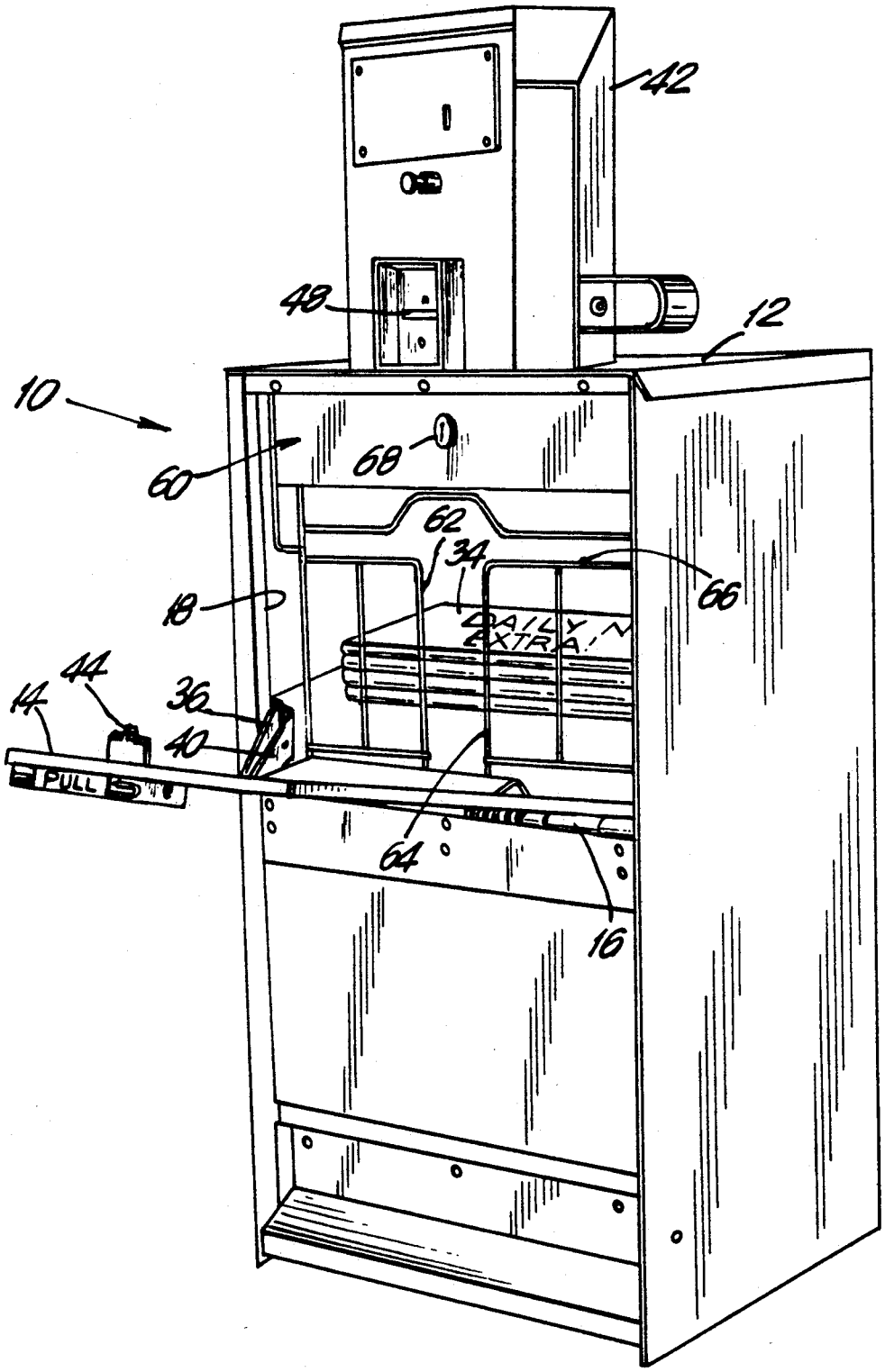
FIG. 2 is a perspective view of the vending machine of FIG. 1 with a theft deterrent device installed across an access opening of the machine according to the invention.

FIG. 2 is a view of the vending machine 10 in FIG. 1 with a theft deterrent device in the form of a cover gate 60 locked in place across the access opening 18. The cover gate 60 forms a generally T-shaped opening 62 having a vertical passageway 64 and a horizontal slot opening 66 for restricting the number of newspapers or other articles that can be withdrawn at one time from inside the cabinet 12. The vertical passageway 64 of the cover gate 60 is of a width just sufficient to allow a customer to pass his or her hand through the cover gate 60 to grasp the topmost article stacked inside the cabinet 12 after the hinged door 14 is opened. The horizontal slot opening 66 is of a width just sufficient to enable the customer to withdraw the topmost article through the opening 66 and out of the dispensing machine 10 before the door 14 is released and again closed against the machine 10. The cover gate 60 has a lock mechanism 68 which enables it to be locked in place over the access opening 18 after the gate 60 engages a fixed part of the machine 10 as explained below.

Figure 3:
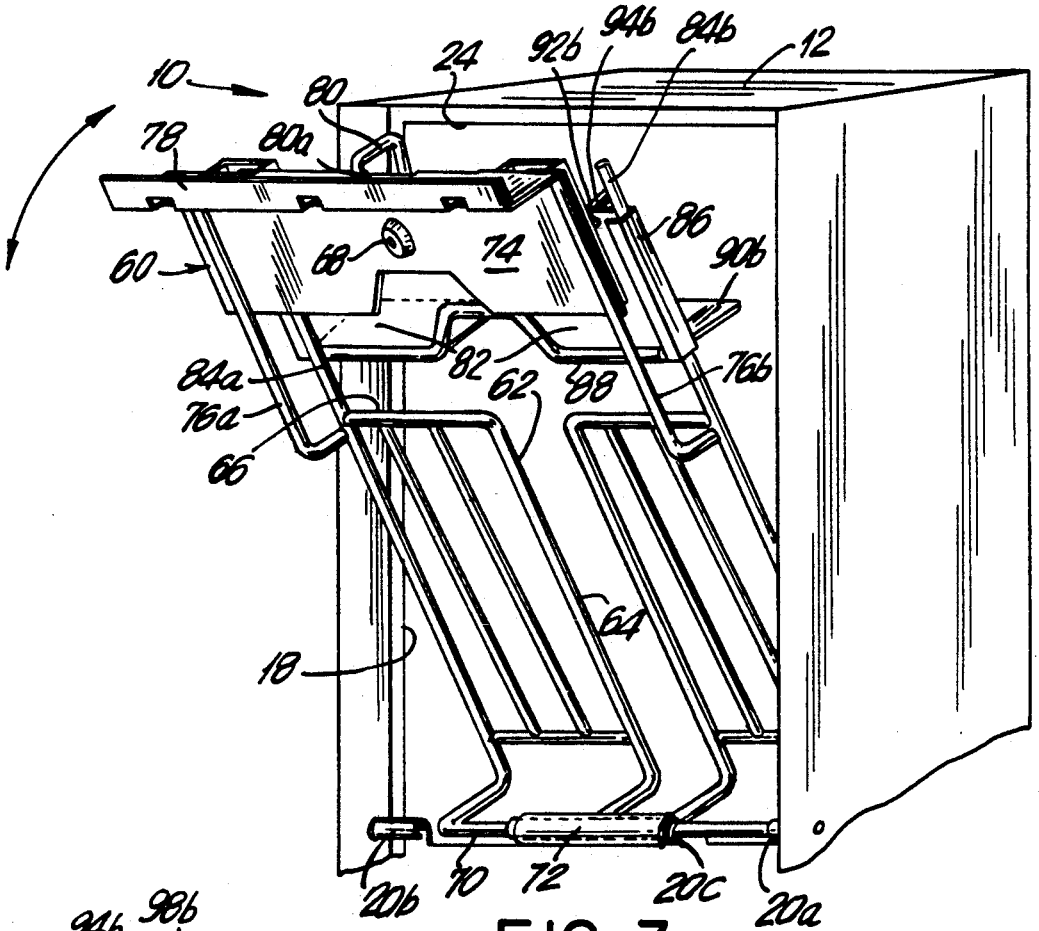
FIG. 3 is a perspective view of the access opening portion of the machine in FIG. 1, depicting the installation or lowering of the theft deterrent device on the machine.

FIG. 3 is a view of the portion of the machine 10 having the access opening 18 with the door 14 and hinge rod 16 removed for purposes of showing further details of the cover gate 60, and the manner by which the gate 60 engages and becomes locked to the machine 10.

In the present embodiment, the cover gate 60 is in the form of a grille or grate comprised of a number of rigid rod members, for example, steel rods of about ¼ inch diameter. The overall width of the cover gate 60 is slightly less than that of the access opening 18, and a lower rod member 70 has a semi-cylindrical member 72 extending parallel to the central portion of the lower rod member 70 for engaging the central ferrule 20*c* of the machine cabinet 12. Member 72 is curved with such a radius as to seat securely on the ferrule 20*c* and to enable the cover gate to pivot about the ferrule 20*c* between a first or open position at which both the hinged door 14 (not shown in FIG. 3) and the cover gate 60 are opened to permit newspapers to be loaded into the cabinet 12 through the access opening 18, and a second or closed position at which the cover gate 60 restricts entry to the newspaper storage part of the cabinet 12 through the access opening 18 and whereat the cover gate 60 can be locked to the machine 10 by operation of the key lock mechanism 68.

Although the cover gate 60 is shown in FIG. 3 as having eight vertically aligned rod members forming the major portion of the cover gate, it will be understood that any number of rod members may be employed and oriented in the vertical and/or horizontal directions, or in a lattice configuration. Also, solid wall portions may be provided in the cover gate 60. As long as the cover gate 60 is constructed to provide a sturdy barrier to entry into the cabinet 12 through the access opening 18, except by way of the T-shaped opening 62, the aim of the present theft deterrent device will be achieved.

Cover gate 60 is locked to the cabinet 12 of the dispensing machine 10 by way of a key (not shown) insertable into the lock mechanism 68. The lock mechanism is mounted on an upper cross plate 74 that is joined at its side ends to two vertical rod members 76*a*, 76*b* of the cover gate 60. An upper lip portion 78 of the cross plate 74 projects forwardly from the major surface of the cross plate 74 and abuts the frontal inside flange 24 of the cabinet 12 when the cover gate 60 is locked to the machine 10.

A catch rod 80 is fixed at one end to the cylinder of the lock mechanism 68 and is formed with two right-angle bends (see FIG. 4) with a distal rod portion 80*a* running parallel to the upper lip portion 78 and positioned so as to catch or jam against the rear surface of the inside flange 24 when the cover gate is closed and the lock mechanism 68 is turned to raise the catch rod 80 upwardly. When unlocking the cover gate 60, the catch rod 80 is rotated downwardly via the lock cylinder, and the distal rod portion 80*a* moves off of the cabinet inside flange 24 and through a clearance opening 81 formed in the horizontal part of the upper lip portion 78 (see FIG. 4).

The width of the horizontal slot opening 66 can be adjusted to accommodate one of a number of different possible thicknesses of individual newspapers or other periodicals stacked inside the cabinet 12, by way of a slide plate assembly 82 which is constructed and arranged to slide in the vertical direction on a pair of vertical rod members 84*a*, 84*b* that extend parallel to and behind the rod members 76*a*, 76*b* that support the upper cross plate 74. Slide plate assembly 82 is comprised of a generally rectangular plate 86 the side ends of which bend at right angles to mount the plate 86 for steady vertical sliding movement along the rod members 84*a*, 84*b*. The lower edge of the plate 86 defines the upper edge of the horizontal slot opening 66 by way of a horizontal rod member 88 joined to the plate 86 along its lower edge. Inasmuch as the vertical rod members 84*a*, 84*b* project upwardly from the lower edge of the horizontal slot opening 66, the plate 86 can be positioned along the mentioned rod members from a lowermost position at which the slot opening 66 is of a minimum width, to an uppermost position defining a maximum width setting for the slot opening 66. Further, a pair of guide plates 90*a*, 90*b* project at right angles from the rectangular plate 86 of the slide plate assembly 82 toward the inside of the cabinet 12, for purposes of guiding a topmost newspaper or other article stacked in cabinet 12 through the horizontal slot opening 66 as the article is being withdrawn by a customer.

A latching mechanism for fixing the plate 86 of the slide plate assembly 82 at a certain position relative to the cover gate 60 to obtain a desired width for the horizontal opening 66, will now be described in connection with FIGS. 3–5.

Figure 4:
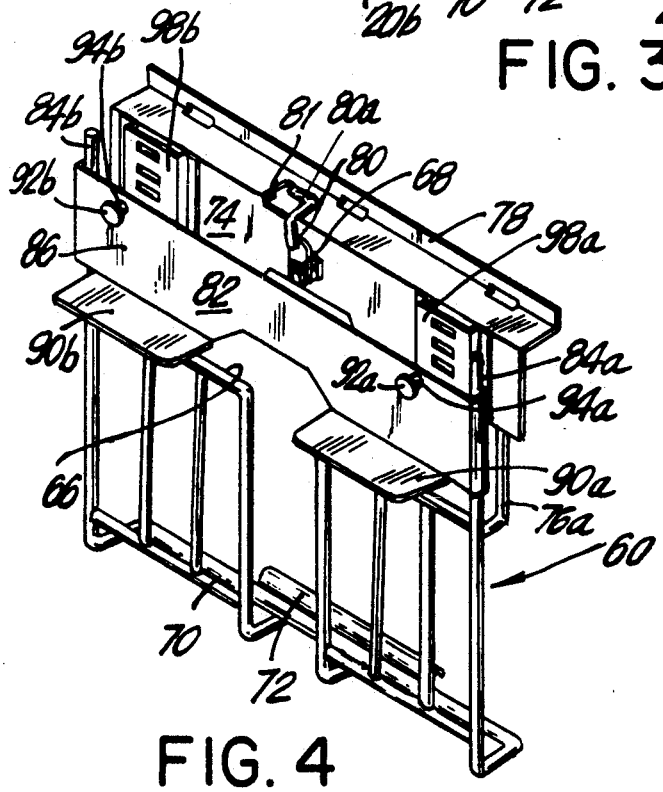
FIG. 4 is a perspective view of the rear side of the theft deterrent device in FIG. 3.

A pair of spring-loaded lock pins 92*a*, 92*b* have their heads projecting from behind the plate 86 at upper left and right sides of the plate as shown in FIG. 4. The pins 92*a*, 92*b* pass through bushings 94*a*, 94*b* fixed on the rear side of the plate 86, with the distal ends of the pins 92*a*, 92*b* projecting toward the rear side of the upper cross plate 74. A bias spring 96 extends concentrically over each of the pins 92*a*, 92*b* with one end of the spring 96 abutting the front surface of the plate 86 and the other end of the spring being captured on the pin by a washer held in place by an abutment pin 98 projecting radially outward from each of the lock pins 92*a*, 92*b*. Accordingly, each of the pins 92*a*, 92*b* is urged to project toward the front of the cover gate 60 and can be retracted from the biased position by pulling upwardly at the head end of each pin when the cover gate 60 is lowered from the cabinet 12.

A pair of U-shaped channel members 98*a*, 98*b* extend vertically on the rear surface of the cross plate 74 with the major surface of each channel member in alignment with the lock pins 92a, 92b. Each of the channel members 98a, 98b has a series of slotted apertures aligned in the direction of the width of the horizontal slot opening 66 which form a series of stops selected ones of which can become engaged with the lock pins 92a, 92b for fixing the plate 86 relative to the cover gate 60. Another embodiment of the latching mechanism for the slide plate assembly will now be explained in connection with FIGS. 6 and 7.

Figure 5:
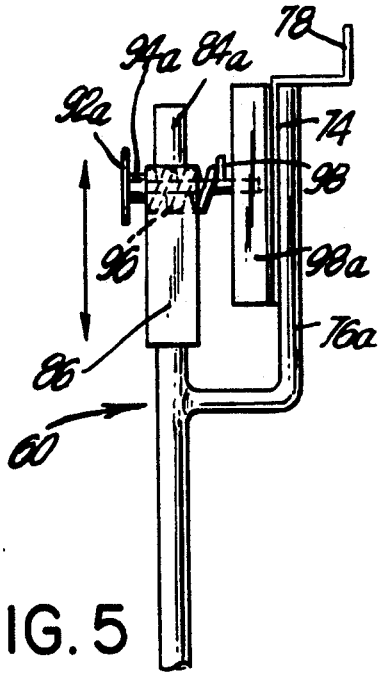
FIG. 5 is an enlarged side end view of the upper portion of the theft deterrent device in FIG. 4.
Figure 6:
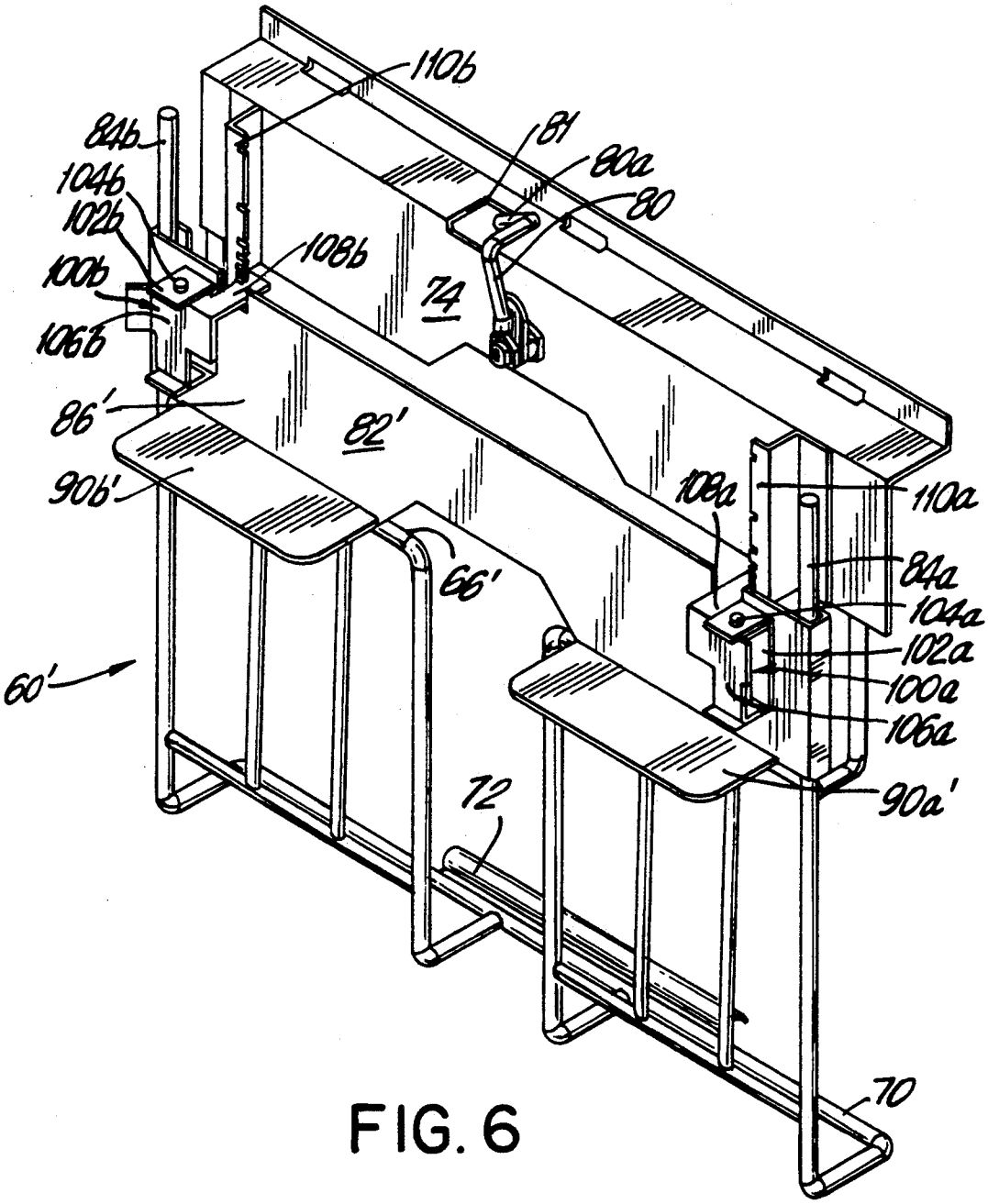
FIG. 6 is a perspective view of the rear side of the theft deterrent device in a second embodiment.
Figure 7:
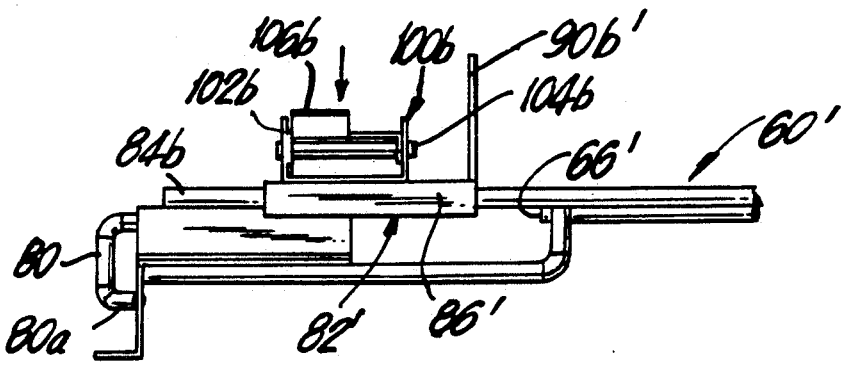
FIG. 7 is a side end view of the upper portion of the device in FIG. 6.

FIG. 6 is a perspective view of the rear side of a cover gate 60' with a different form of latching mechanism than that shown in FIGS. 4 and 5. FIG. 7 is a side end view of the upper portion of the cover gate 60' in FIG. 6 as seen when the gate 60' is lowered to permit loading of newspapers in an associated vending machine (not shown in FIGS. 6 and 7). Cover gate 60' has a slide plate assembly 82' including generally rectangular plate 86' the side ends of which bend at right angles for mounting the plate 86' for smooth vertical sliding movement along the rod members 84a, 84b of the cover gate 60'. The lower edge of the plate 86' defines the upper edge of the horizontal slot opening 66' by way of a horizontal rod member joined to the plate 86' along its lower front edge. As in the embodiment of FIG. 4, the plate 86' can be positioned along the rod members 84a, 84b from a lowermost position defining a minimum width for the slot opening 66', to an uppermost position defining a maximum thickness setting for the slot opening 66'. Guide plates 90a', 90b' project at right angles from the rectangular plate 86' toward the inside of the vending machine cabinet 12, for purposes of guiding the topmost newspaper stored in the cabinet 12 through the slot opening 66' as the paper is withdrawn by the customer.

Latching of the plate 86' at a certain position relative to the cover gate 60' in order to obtain a desired width for the slot opening 66', is carried out as follows.

A pair of finger operated, spring-loaded latch lever assemblies 100a, 100b project from behind the plate 86' at upper left and right sides of the plate as shown in FIG. 6. Each assembly is comprised of a U-shaped bracket 102a, 102b fixed on its bottom side to the plate 86' and aligned in the direction of the rod members 84a, 84b. Pivot pins 104a, 104b extend within each of the brackets 102a, 102b, respectively, and project through openings in the side ends of each bracket. Each pin is fixed axially by suitable means such as split washers at its ends (not shown). Rocker levers 106a, 106b are pivoted on associated pins 104a, 104b and are urged by suitable spring means (not shown) toward a position at which a tongue part 108a, 108b of each lever rides along the free edge of a corresponding flange 110a, 110b on the rear side of upper cross plate 74. The tongue parts 108a, 108b project at right angles to the plate 86', with their distal ends emerging from recessed openings cut in the upper edge of the plate 86' to face the rear side of the upper cross plate 74.

Each of the flanges, 110a, 110b has a series of open-ended slots cut into its free edge as shown in FIG. 6. Accordingly, selected ones of the slots can be engaged by side edges of the tongue parts 108a, 108b of the rocker levers for fixing the plate 86' relative to the cover gate 60'. As shown in FIG. 7, with the cover gate 60' lowered from the front of the access opening of the vending machine (not shown), it is relatively easy for a newspaper delivery person to operate the latch lever assemblies 100a, 100b to set the width of the slot opening 66', merely by pressing downwardly on the rocker levers 106a, 106b and sliding the entire plate assembly 82' relative to the cover gate 60' to a position just sufficient to permit a current edition of a newspaper to be withdrawn through the opening 66'.

Figure 8:
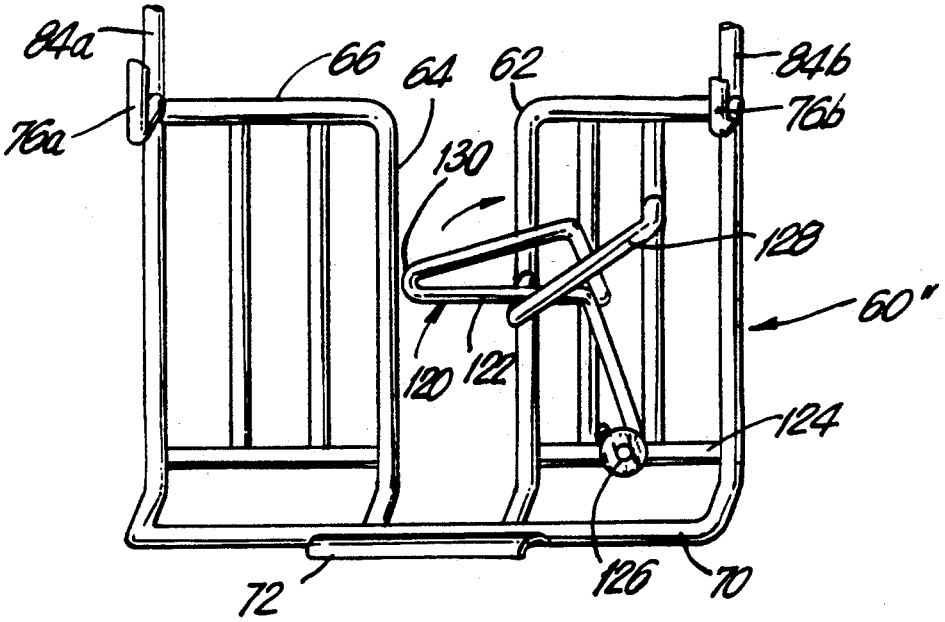
FIG. 8 is a perspective view of the front side of a third embodiment of the theft deterrent device.

FIG. 8 is a front view of another embodiment of the cover gate 60'' in which the cover gate is provided with means for restricting the passage of newspapers or other articles stored inside a vending machine with which the cover gate 60'' is associated, through the vertical passageway 64 of the T-shaped opening 62 in the cover gate. Specifically, since the vertical passageway 64 must be wide enough to allow a customer to insert his/her hand and wrist through the passageway 64 in order to grasp a newspaper or periodical stored in the machine and lift the item upwardly and out through the horizontal slot opening 66, the vertical passageway 64 must of necessity be at least about 3 inches wide. Such a width for the passageway 64 may be sufficient to permit several daily newspapers to be withdrawn through the passageway 64, rather than the horizontal slot opening 66, even if the newspapers are folded together by a dishonest customer and pulled out of the machine through the vertical passageway 64. Such potential theft may be overcome by providing a movable guard mechanism 120 as shown in FIG. 8. Guard mechanism 120 includes a generally triangularly-shaped rod 122 a base part of which is pivoted to a bottom cross rod 124 by a pivot bolt and washer at 126, as shown.

The triangularly shaped rod 122 rests under the influence of gravity at a closed position shown in FIG. 8 whereat a major portion of the rod 122 obstructs the passageway 64. The rod 122 is supported in the closed position by one end of a U-shaped rod 128 that is welded at each of its ends to a pair of vertical rod members on the right-half portion of the cover gate 60'. Rod 128 extends forwardly of the vertical rod members an amount sufficient to allow the pivoted rod 122 to swing up and toward the right as shown by the arrow when a customer lifts his/her wrist up from beneath the rod 122 prior to withdrawing the newspaper through the upper horizontal slot opening 66. Rod 122 is preferably dimensioned and formed so as to be capable of swinging toward the right by such an amount that the leading end 130 of the rod 122 clears or almost clears the vertical passageway 64. After the customer's hand or wrist moves upwardly in the passageway 64 to withdraw the newspaper through the slot opening 66, the rod 122 will fall by gravity to obstruct the passageway 64 as is shown in FIG. 8.

Figure 9:
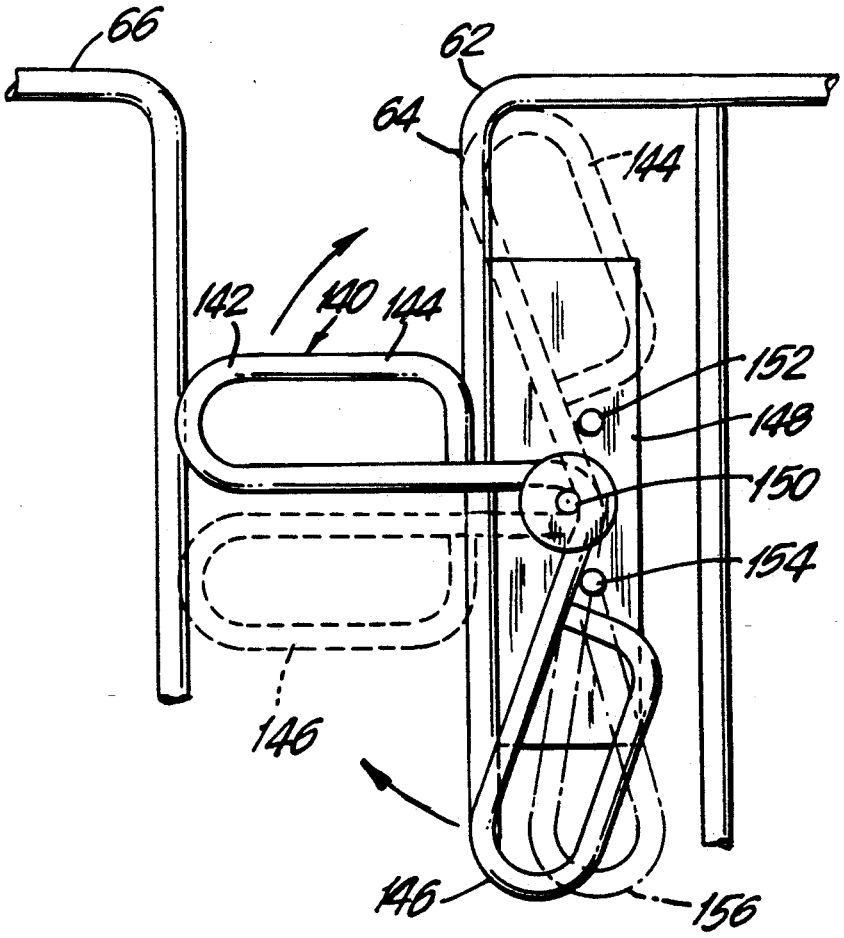
FIG. 9 is a view of part of the front side of a fourth embodiment of the theft deterrent device.

FIG. 9 is a view of yet another embodiment of the present theft deterrent device showing a different movable guard mechanism 140 than that shown in FIG. 8, for obstructing the vertical passageway 64 to prevent withdrawal of stored articles through the passageway 64 instead of through the slot opening 66. A generally "V"-shaped rod 142 is formed with an upper ear loop 144 and a lower ear loop 146. The rod 142 is pivoted at the base of the V to a gusset plate 148 by a pivot bolt and washer at 150, as shown. Plate 148 is welded along its left vertical edge to the rear side of a cover gate rod member that defines the right edge of the vertical passageway 64. The rod 142 pivots freely in a plane just forward of the plane of the passageway 64 in the cover gate, and its travel is limited by stop pins 152, 154 projecting forward of the plate 148 to define upper and lower positions for the rod 142. Rod 142 normally rests by gravity at the lower position as depicted in solid lines in FIG. 9. When a customer's hand or wrist moves up in the passageway 64 beneath the upper loop 144 while grasping an article to be removed through slot opening 66, the upper loop 144 pivots up toward the right and clear of the passageway 64, while the lower loop 146 swings up to maintain the passageway 64 in an obstructed condition. Once the customer's wrist leaves the passageway 64, the rod 142 falls by gravity and the upper loop 144 again serves to obstruct the passageway 64.

The form of the end ear loops 144, 146 is shown as being generally rectangular in FIG. 9. It will be understood that other forms such as a "teardrop" depicted by 156 in the figure may be used at the ends of the rod 142, however.

In use, the present deterrent device can be attached to most any of the existing newspaper vending machines of the kind having a door behind which a supply of newspapers or magazines are stacked.

The present deterrent device in the form of cover gate 60 is attached at a lower edge to a fixed member (20*c*) in the region of an access opening of an existing dispensing machine. An engagement member (72) on the cover gate is formed in a shape that is complementary to that of the fixed member in the machine. A key lock mechanism (68) is provided at the top of the cover gate 60.

In the present embodiment, the engagement member 72 is semi-cylindrical and sized to rest on and slide smoothly over a central ferrule 20*c* that holds a door hinge rod 16 in place. With the engagement member in place on the ferrule, the deterrent device is rotated to a vertical position and locked in place over the access opening. When the lock mechanism is unlocked, the device can be lowered or rotated over the ferrule to a horizontal position to allow bulk loading of newspapers or magazines inside the cabinet through the access opening.

With the present device in a locked position, the customer gains access to newspapers or magazines in the machine 10 by placing his/her hand through the vertical passageway 64 and lifting a topmost newspaper upward until the newspaper reaches the horizontal slot opening 66 which is set wide enough to pass the newspaper from inside the cabinet. When the device is unlocked and lowered, the width of the horizontal slot opening can be adjusted by way of the slide plate assembly 82 that defines a top edge of the slot opening. Because of significantly different newspaper thicknesses from day to day and on Sunday, adjustment of the slide plate assembly may be required on a daily basis. Such adjustment is, however, easily carried out on-site according to the invention.

In one embodiment of the slide plate assembly, two spring loaded lock pins 92*a*, 92*b* are mounted on a sliding plate 86 and are arranged to register with and enter a pair of selected stops formed on an upper cross plate 74 of the present device. When the lock pins are retracted out of the stops, the plate 86 can be moved easily to adjust the width of the slot opening and the pins then released to engage a different set of stops. Accordingly, the quantity of newspapers that can be removed by a customer at one time is restricted by setting the width of the horizontal slot opening via the slide plate assembly 82. In a second embodiment, spring loaded rocker levers 106*a*, 106*b* are mounted on the rear surface of sliding plate 86', and are arranged to engage selected open ended slots in flanges 110*a*, 110*b* that are fixed to the upper cross plate 74.

While the foregoing description represents a preferred embodiment of the present invention, it will be obvious to those skilled in the art that various changes and modifications may be made.

For example, in the disclosed embodiment, the semi-cylindrical engagement member 72 is fixed onto lower rod member 70 and pivots about the central ferrule 20*c* that holds the door hinge rod 16 of the dispensing machine 10 in place. In some dispensing machines, a fixed member having a cylindrical surface such as ferrule 20*c*, may not be provided for engaging the present device securely. Such a machine is currently used to vend the Gannett "USA Today" newspapers and is also available from EB Metal Industries as model GSR. To accommodate such machines, one or more bracket members may be pivoted on a lower rod member of the cover gate, and the bracket members formed and dimensioned to seat firmly over a fixed member such as a projecting flange near the bottom edge of the access opening in the machine. That is, the mentioned bracket members may be held firmly in place over a flange or other fixed member of a vending machine, and support the cover gate while it is pivoted between an opened loading position and a locked position as described herein.

Further, the catch rod 80 of the lock mechanism 68 is shown in the drawing as catching or jamming against the rear surface of an existing flange inside the dispensing machine 10. For some machines such as the mentioned "USA Today" kind, it may be desirable to extend the lower edge of an existing upper flange at the access opening of the machine simply with a rigid sheet metal lip or the like, thus allowing the height of the cover gate to be limited so that the gate can be swung downwardly without interfering with other parts of the machine. The metal lip then operates with the lock mechanism on the cover gate, by providing a rigid member on the machine against which the catch rod of the lock mechanism can act effectively to keep the cover gate in a locked condition.

Accordingly, the scope of the invention is pointed out and determined by the following claims.

What is claimed is:

1. A guard mechanism for restricting passage of newspapers or other periodicals stored in a vending machine through a vertical passageway in a theft deterrent device arranged to cover an access opening of the vending machine, said mechanism comprising an angularly shaped member, means for pivoting said member to said deterrent device for free swinging movement, and means on said deterrent device for retaining said member at a closed position obstructing said vertical passageway and for guiding the member when swung to an open position in response to upward motion of a customer's hand or wrist within said vertical passageway.

2. The guard mechanism of claim 1, wherein said angularly shaped member is a generally triangularly shaped rod a base part of which is connected to said pivoting means.

3. The guard mechanism of claim 1, wherein said angularly shaped member is a generally V-shaped rod that is connected to said pivoting means at the base of the V.

4. The guard mechanism of claim 3, wherein the V-shaped rod is formed with an upper loop part and a lower loop part, wherein said upper loop part normally obstructs said vertical passageway, and said lower loop part swings to maintain the passageway in an obstructed condition when said upper loop part is swung clear of the passageway by movement of a customer's hand or wrist.

5. A theft deterrent device for restricting the number of newspapers, magazines or other articles that can be retrieved from inside a storage portion of a newspaper dispensing machine wherein said dispensing machine has a hinged door for covering an access opening of the machine and through which opening articles can be loaded into and withdrawn from the storage portion of the machine, said device comprising:

cover gate means forming a generally T-shaped opening having a vertical passageway and a horizontal slot opening, for mounting in the region of the access opening of the dispensing machine behind said hinged door and for restricting the number of articles that can be withdrawn at one time from the storage portion;

engagement means on said cover gate means for securely engaging a fixed member associated with the dispensing machine in the region of the access opening;

lock means on said cover gate means for locking the cover gate means to the dispensing machine over said access opening after said engagement means engages said fixed member; wherein the vertical passageway of said cover gate means is of a width just sufficient to allow a customer to pass his or her hand through the gate means to grasp a topmost article stacked in the storage portion after the dispensing machine door is opened; and the horizontal slot opening is of a width just sufficient to enable the customer to withdraw the topmost article stacked in the storage portion through the slot opening and out of the dispensing machine before the door is released by the customer and closed against the dispensing machine;

slide means on said cover gate means for setting the horizontal slot opening of said T-shaped opening to a desired width corresponding to one of a number of different possible thicknesses of articles loaded in the storage portion of the dispensing machine;

wherein said slide means includes a plate member an edge of which defines a horizontal edge of said horizontal slot opening; and latching means for fixing said plate member at a desired position relative to the horizontal slot opening in said cover gate means to obtain the desired width for said slot opening;

wherein said latching means includes means on said cover gate means forming a series of stops aligned in the width direction of the horizontal slot opening, and lock pin means on said plate member for engaging selected ones of said stops to fix the plate member at the desired position relative to the slot opening in said cover gate means.

6. A theft deterrent device for restricting the number of newspapers, magazines or other articles that can be retrieved from inside a storage portion of a newspaper dispensing machine wherein said dispensing machine has a hinged door for covering an access opening of the machine and through which opening articles can be loaded into and withdrawn from the storage portion of the machine, said device comprising:

cover gate means forming a generally T-shaped opening having a vertical passageway and a horizontal slot opening, for mounting in the region of the access opening of the dispensing machine behind said hinged door and for restricting the number of articles that can be withdrawn at one time from the storage portion;

engagement means on said cover gate means for securely engaging a fixed member associated with the dispensing machine in the region of the access opening;

lock means on said cover gate means for locking the cover gate means to the dispensing machine over said access opening after said engagement means engages said fixed member; wherein the vertical passageway of said cover gate means is of a width just sufficient to allow a customer to pass his or her hand through the gate means to grasp a topmost article stacked in the storage portion after the dispensing machine door is opened; and the horizontal slot opening is of a width just sufficient to enable the customer to withdraw the topmost article stacked in the storage portion through the slot opening and out of the dispensing machine before the door is released by the customer and closed against the dispensing machine;

slide means on said cover gate means for setting the horizontal slot opening of said T-shaped opening to a desired width corresponding to one of a number of different possible thicknesses of articles loaded in the storage portion of the dispensing machine;

wherein said slide means includes a plate member an edge of which defines a horizontal edge of said horizontal slot opening; and latching means for fixing said plate member at a desired position relative to the horizontal slot opening in said cover gate means to obtain the desired width for said slot opening;

wherein said latching means includes means on said cover gate means forming a series of open-ended slots aligned in succession along the width direction of the horizontal slot opening, and rocker lever means on said plate member for engaging selected ones of said open-ended slots to fix the plate member at the desired position relative to the horizontal slot opening in said cover gate means.

7. A theft deterrent device for restricting the number of newspapers, magazines or other articles that can be retrieved from inside a storage portion of a newspaper dispensing machine wherein said dispensing machine has a hinged door for covering an access opening of the machine and through which opening articles can be loaded into and withdrawn from the storage portion of the machine, said device comprising:

cover gate means forming a generally T-shaped opening having a vertical passageway and a horizontal slot opening, for mounting in the region of the access opening of the dispensing machine behind said hinged door and for restricting the number of articles that can be withdrawn at one time from the storage portion;

engagement means on said cover gate means for securely engaging a fixed member associated with the dispensing machine in the region of the access opening;

lock means on said cover gate means for locking the cover gate means to the dispensing machine over said access opening after said engagement means engages said fixed member; wherein the vertical passageway of said cover gate means is of a width just sufficient to allow a customer to pass his or her hand through the gate means to grasp a topmost article stacked in the storage portion after the dispensing machine door is opened; and the horizontal slot opening is of a width just sufficient to enable the customer to withdraw the topmost article stacked in the storage portion through the slot opening and out of the dispensing machine before the door is released by the customer and closed against the dispensing machine; and movable guard means on said cover gate means for obstructing an attempted withdrawal of articles from the storage portion of the dispensing machine through said vertical passageway;

wherein said movable guard means includes an angularly shaped member, means for pivoting said member to said cover gate means for free swinging movement, and means on said cover gate means for retaining said member at a closed position and for guiding the member when swung to an open position in response to upward motion of a customer's hand or wrist.

8. A theft deterrent device according to claim 7, wherein said angularly shaped member is a generally triangularly shaped rod a base part of which is connected to said pivoting means.

9. A theft deterrent device according to claim 7, wherein said angularly shaped member is a generally V-shaped rod that is connected to said pivoting means at the base of the V.

10. A theft deterrent device according to claim 9, wherein the V-shaped rod is formed with an upper loop part and a lower loop part, wherein said upper loop part normally obstructs said vertical passageway, and said lower loop part swings to maintain the passageway in an obstructed condition when said upper loop part is swung clear of the passageway by movement of a customer's hand or wrist.

11. A theft deterrent device for restricting the number of newspapers, magazines or other articles that can be retrieved from inside a storage portion of a newspaper dispensing machine wherein said dispensing machine has a hinged door for covering an access opening of the machine and through which opening articles can be loaded into and withdrawn from the storage portion of the machine, said device comprising:

cover gate means forming a generally T-shaped opening having a vertical passageway and a horizontal slot opening, for mounting in the region of the access opening of the dispensing machine behind said hinged door and for restricting the number of articles that can be withdrawn at one time from the storage portion;

engagement means in the vicinity of a first end of said cover gate means for securely engaging a first fixed member associated with the dispensing machine in the region of the access opening, wherein said engagement means comprises pivot means formed to seat securely on said first fixed member, said pivot means operating to pivot the cover gate means about said first fixed member between a first position at which both the hinged door of the dispensing machine and the cover gate means are opened to permit articles to be loaded into the storage portion of the dispensing machine through said access opening, and a second position at which the cover gate means restricts entry to said storage portion through the access opening and becomes lockable to said machine;

lock means in the vicinity of a second end of said cover gate means opposite said first end, for engaging a second fixed member associated with the dispensing machine in the region of the access opening so that the cover gate means is locked to the dispensing machine over said access opening with said engagement means engaging said first fixed member; wherein the vertical passageway of said cover gate means is of a width just sufficient to allow a customer to pass his or her hand through the gate means to grasp a topmost article stacked in the storage portion after the dispensing machine door is opened; and the horizontal slot opening is of a width just sufficient to enable the customer to withdraw the topmost article stacked in the storage portion through the slot opening and out of the dispensing machine before the door is released by the customer and closed against the dispensing machine;

slide means on said cover gate means for setting the horizontal slot opening of said T-shaped opening to a desired width corresponding to one of a number of different possible thicknesses of articles loaded in the storage portion of the dispensing machine;

wherein said slide means includes a plate member an edge of which defines a horizontal edge of said horizontal slot opening; and latching means for fixing said plate member at a desired position relative to the horizontal slot opening in said cover gate means to obtain the desired width for said slot opening;

wherein said latching means includes means on said cover gate means forming a series of stops aligned in the width direction of the horizontal slot opening, and lock pin means on said plate member for engaging selected ones of said stops to fix the plate member at the desired position relative to the slot opening in said cover gate means.

12. A theft deterrent device according to claim 11, wherein said cover gate means comprises a grate formed of a number of rigid rod members.

13. A theft deterrent device according to claim 11, wherein said pivot means comprises a semi-cylindrical member fixed to said cover gate means and formed to seat against and pivot over a ferrule part of the dispensing machine.

14. A theft deterrent device according to claim 11, comprising at least one guide plate projecting from behind said plate member of said slide means for guiding the topmost article through said horizontal slot opening as said topmost article is withdrawn by the customer.

15. A theft deterrent device for restricting the number of newspapers, magazines or other articles that can be retrieved from inside a storage portion of a newspaper dispensing machine wherein said dispensing machine has a hinged door for covering an access opening of the machine and through which opening articles can be loaded into and withdrawn from the storage portion of the machine, said device comprising:

cover gate means forming a generally T-shaped opening having a vertical passageway and a horizontal slot opening, for mounting in the region of the access opening of the dispensing machine behind said hinged door and for restricting the number of articles that can be withdrawn at one time from the storage portion;

engagement means in the vicinity of a first end of said cover gate means for securely engaging a first fixed member associated with the dispensing machine in the region of the access opening, wherein said engagement means comprises pivot means formed to seat securely on said first fixed member, said pivot means operating to pivot the cover gate means about said first fixed member between a first position at which both the hinged door of the dispensing machine and the cover gate means are opened to permit articles to be loaded into the storage portion of the dispensing machine through said access opening, and a second position at which the cover gate means restricts entry to said storage portion through the access opening and becomes lockable to said machine;

lock means in the vicinity of a second end of said cover gate means opposite said first end, for engaging a second fixed member associated with the dispensing machine in the region of the access opening so that the cover gate means is locked to the dispensing machine over said access opening with said engagement means engaging said first fixed member; wherein the vertical passageway of said cover gate means is of a width just sufficient to allow a customer to pass his or her hand through the gate means to grasp a topmost article stacked in the storage portion after the dispensing machine door is opened; and the horizontal slot opening is of a width just sufficient to enable the customer to withdraw the topmost article stacked in the storage portion through the slot opening and out of the dispensing machine before the door is released by the customer and closed against the dispensing machine;

slide means on said cover gate means for setting the horizontal slot opening of said T-shaped opening to a desired width corresponding to one of a number of different possible thicknesses of articles loaded in the storage portion of the dispensing machine;

wherein said slide means includes a plate member an edge of which defines a horizontal edge of said horizontal slot opening; and latching means for fixing said plate member at a desired position relative to the horizontal slot opening in said cover gate means to obtain the desired width for said slot opening;

wherein said latching means includes means on said cover gate means forming a series of open-ended slots aligned in succession along the width direction of the horizontal slot opening, and rocker lever means on said plate member for engaging selected ones of said open-ended slots to fix the plate member at the desired position relative to the horizontal slot opening in said cover gate means.

16. A theft deterrent device according to claim 15, wherein said cover gate means comprises a grate formed of a number of rigid rod members.

17. A theft deterrent device according to claim 15, wherein said pivot means comprises a semi-cylindrical member fixed to said cover gate means and formed to seat against and pivot over a ferrule part of the dispensing machine.

18. A theft deterrent device according to claim 15, comprising at least one guide plate projecting from behind said plate member of said slide means for guiding the topmost article through said horizontal slot opening as said topmost article is withdrawn by the customer.

19. A theft deterrent device for restricting the number of newspapers, magazines or other articles that can be retrieved from inside a storage portion of a newspaper dispensing machine wherein said dispensing machine has a hinged door for covering an access opening of the machine and through which opening articles can be loaded into and withdrawn from the storage portion of the machine, said device comprising:

cover gate means forming a generally T-shaped opening having a vertical passageway and a horizontal slot opening, for mounting in the region of the access opening of the dispensing machine behind said hinged door and for restricting the number of articles that can be withdrawn at one time from the storage portion;

engagement means in the vicinity of a first end of said cover gate means for securely engaging a first fixed member associated with the dispensing machine in the region of the access opening, wherein said engagement means comprises pivot means formed to seat securely on said first fixed member, said pivot means operating to pivot the cover gate means about said first fixed member between a first position at which both the hinged door of the dispensing machine and the cover gate means are opened to permit articles to be loaded into the storage portion of the dispensing machine through said access opening, and a second position at which the cover gate means restricts entry to said storage portion through the access opening and becomes lockable to said machine;

lock means in the vicinity of a second end of said cover gate means opposite said first end, for engaging a second fixed member associated with the dispensing machine in the region of the access opening so that the cover gate means is locked to the dispensing machine over said access opening with said engagement means engaging said first fixed member; wherein the vertical passageway of said cover gate means is of a width just sufficient to allow a customer to pass his or her hand through the gate means to grasp a topmost article stacked in the storage portion after the dispensing machine door is opened;

the horizontal slot opening is of a width just sufficient to enable the customer to withdraw the topmost article stacked in the storage portion through the slot opening and out of the dispensing machine before the door is released by the customer and closed against the dispensing machine; and movable guard means on said cover gate means for obstructing an attempted withdrawal of articles from the storage portion of the dispensing machine through said vertical passageway;

wherein said movable guard means includes an angularly shaped member, means for pivoting said member to said cover gate means for free swinging movement, and means on said cover gate means for retaining said member at a closed position and for guiding the member when swung to an open position in response to upward motion of a customer's hand or wrist.

20. A theft deterrent device according to claim 19, wherein said angularly shaped member is a generally triangularly shaped rod a base part of which is connected to said pivoting means.

21. A theft deterrent device according to claim 19, wherein said angularly shaped member is a generally V-shaped rod that is connected to said pivoting means at the base of the V.

22. A theft deterrent device according to claim 21, wherein the V-shaped rod is formed with an upper loop part and a lower loop part, wherein said upper loop part normally obstructs said vertical passageway, and said lower loop part swings to maintain the passageway in an obstructed condition when said upper loop part is swung clear of the passageway by movement of a customer's hand or wrist.

23. A theft deterrent device according to claim 19, wherein said cover gate means comprises a grate formed of a number of rigid rod members.

24. A theft deterrent device according to claim 19, wherein said pivot means comprises a semi-cylindrical member fixed to said cover gate means and formed to seat against and pivot over a ferrule part of the dispensing machine.

* * * * *